US009338556B2

(12) United States Patent
Onishi

(10) Patent No.: US 9,338,556 B2
(45) Date of Patent: May 10, 2016

(54) ELECTROACOUSTIC TRANSDUCER, MANUFACTURING METHOD THEREOF, AND ELECTRONIC DEVICE UTILIZING SAME

(71) Applicant: NEC CASIO MOBILE COMMUNICATIONS, LTD., Kawasaki-shi, Kanagawa (JP)

(72) Inventor: Yasuharu Onishi, Kanagawa (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 14/434,174

(22) PCT Filed: Oct. 11, 2013

(86) PCT No.: PCT/JP2013/077753
§ 371 (c)(1),
(2) Date: Apr. 8, 2015

(87) PCT Pub. No.: WO2014/061584
PCT Pub. Date: Apr. 24, 2014

(65) Prior Publication Data

US 2015/0264488 A1 Sep. 17, 2015

(30) Foreign Application Priority Data

Oct. 15, 2012 (JP) ..... 2012-227920

(51) Int. Cl.

| | |
|---|---|
| ***H04R 25/00*** | (2006.01) |
| ***H04R 17/00*** | (2006.01) |
| ***H04R 31/00*** | (2006.01) |
| *H04R 1/40* | (2006.01) |

(52) U.S. Cl.
CPC ..... *H04R 17/00* (2013.01); *H04R 31/00* (2013.01); *H04R 1/403* (2013.01); *H04R 2217/03* (2013.01); *Y10T 29/42* (2015.01)

(58) Field of Classification Search
CPC ..... G10H 1/043; G10H 1/047; G10H 1/049; G10H 2210/201; G10H 2201/215; H01M 1/03; H04R 1/04; H04R 1/083; H04R 1/086; H04R 1/26; H04R 1/222; H04R 1/225; H04R 1/2857; H04R 1/2888; H04R 7/045; H04R 15/00; H04R 17/00; H04R 17/005; H04R 17/02; H04R 19/04; H04R 19/06; H04R 19/016; H04R 21/02; H04R 25/60; H04R 25/65; H04R 25/604; H04R 25/652; H04R 25/658; H04R 2499/11
USPC ..... 381/162, 173, 190, 322, 353, 369
See application file for complete search history.

(56) References Cited

U.S. PATENT DOCUMENTS 8,144,910 B2 * 3/2012 Saltykov ..... H04R 25/604 381/322

FOREIGN PATENT DOCUMENTS

| | | | |
|---|---|---|---|
| JP | 2006-246279 | A | 9/2006 |
| JP | 2007-082052 | A | 3/2007 |
| JP | 2012-100043 | A | 5/2012 |
| WO | 2012/131825 | A1 | 10/2012 |

OTHER PUBLICATIONS

International Search Report for PCT Application No. PCT/JP2013/077753, mailed on Nov. 5, 2013.

* cited by examiner

*Primary Examiner* — Brian Ensey

(57) ABSTRACT

An electroacoustic transducer comprises a piezoelectric vibrator; a casing being provided with a predetermined space from the piezoelectric vibrator and including a frustum shape cutout in an inner wall thereof; and an acoustic absorption material being fitted in the cutout wherein a sound hole is formed in the casing in front of the piezoelectric vibrator in an oscillating direction of the piezoelectric vibrator; and the casing is formed in the casing such that a hole diameter of a sound path decreases toward a front end in the oscillating direction of the piezoelectric vibrator.

10 Claims, 6 Drawing Sheets

ELECTROACOUSTIC TRANSDUCER, MANUFACTURING METHOD THEREOF, AND ELECTRONIC DEVICE UTILIZING SAME

This application is a National Stage Entry of PCT/JP2013/077753 filed on Oct. 11, 2013, which claims priority from Japanese Patent Application 2012-227920 filed on Oct. 15, 2012, the contents of all of which are incorporated herein by reference, in their entirety.

REFERENCE TO RELATED APPLICATION

The present invention is based upon and claims the benefit of the priority of Japanese patent application No. 2012-227920, filed on Oct. 15, 2012, the disclosure of which is incorporated herein in its entirety by reference thereto.

TECHNICAL FIELD

The present invention relates to an electroacoustic transducer, a manufacturing method thereof, and an electronic device utilizing same.

BACKGROUND

In recent year, a parametric speaker with high directivity to propagate sound to a person at a particular position is getting attention. It is expected to mount the parametric speaker on an electronic device, for example, a mobile phone, etc., and is expected to be used for propagating a sound signal around a user, etc.

Here, when the parametric speaker is mounted on the electronic device, for example, a mobile phone, etc., it is desired to miniaturize the parametric speaker. However, it is difficult to miniaturize an electro-dynamic electroacoustic transducer in its principle. Therefore, it is expected to use an electroacoustic transducer using a piezoelectric vibrator.

Patent Literature 1 discloses an electroacoustic transducer comprising a piezoelectric vibrator, and being enabled to use in broadband including a low frequency band.

[Patent Literature 1]

Japanese Patent Kokai Publication No. 2006-246279A

SUMMARY

The disclosure of the above Patent Literature is incorporated herein by reference thereto. The following analysis has been given by the present invention.

It is preferred for the parametric speaker with high directivity to propagate a sound signal via an ultrasonic wave(s). And, it is preferred to transmit an ultrasonic wave(s) with a high sound pressure level in order to transmit an ultrasonic wave(s) with high directivity using a piezoelectric vibrator. However, in order to transmit an ultrasonic wave(s) with a high sound pressure level, it is necessary to apply high voltage to the piezoelectric vibrator. In other word, a voltage applied to a piezoelectric vibrator and a directivity of a transmitted ultrasonic wave(s) have a trade-off relationship.

Patent Literature 1 does not disclose the technique to transmit an ultrasonic wave(s) with high efficiency using a piezoelectric vibrator.

Therefore, there is a need in the art to contribute to transmitting a highly directional acoustic wave(s) with high efficiency.

According to a first aspect, there is provided an electroacoustic transducer, comprising: a piezoelectric vibrator; a casing being provided with a predetermined space from the piezoelectric vibrator and including a frustum shape cutout in an inner wall thereof; and an acoustic absorption material being fitted in the cutout; wherein a sound hole is formed in the casing in front of the piezoelectric vibrator in an oscillating direction of the piezoelectric vibrator; and the casing is formed in the casing such that a hole diameter of a sound path decreases toward a front end in the oscillating direction of the piezoelectric vibrator.

According to a second aspect, there is provided an electronic device comprising an electroacoustic transducer that comprises: a piezoelectric vibrator; a casing being provided with a predetermined space from the piezoelectric vibrator and including a frustum shape cutout in an inner wall thereof; and an acoustic absorption material being fitted in the cutout; wherein a sound hole is formed in the casing in front of the piezoelectric vibrator in an oscillating direction of the piezoelectric vibrator; and the casing is formed in the casing such that a hole diameter of a sound path decreases toward a front end in the oscillating direction of the piezoelectric vibrator, and oscillating the piezoelectric vibrator such that an ultrasonic wave(s) having more than 20 kHz frequency is emitted.

According to a third aspect, there is provided a manufacturing method of an electroacoustic transducer comprising a piezoelectric vibrator and a casing, the manufacturing method comprising: providing with a predetermined space from a piezoelectric vibrator; forming a frustum shape cutout in an inner wall of the casing; disposing a acoustic absorption fitted in the cutout; and forming a sound hole in the casing in front of the piezoelectric vibrator in an oscillating direction of the piezoelectric vibrator; wherein, the cutout is formed in the casing such that a hole diameter of a sound path decreases toward a front end in the oscillating direction of the piezoelectric vibrator.

According to each aspect of the present invention, an electroacoustic transducer contributing oscillating a highly directional acoustic wave(s) with high efficiency and a manufacturing method thereof, and an electronic device utilizing same are provided.

PREFERRED MODES

First, a summary of an exemplary embodiment of the present invention will be given using FIG. 1. Note that drawing reference signs in the summary are given to each element for convenience as examples solely for facilitating understanding, and the description of the summary is not intended to suggest any limitation.

As described above, a voltage applied to a piezoelectric vibrator and a directivity of a transmitted ultrasonic wave(s) have trade-off relation. Therefore, an electroacoustic transducer contributing to transmitting a highly directional acoustic wave(s) with high efficiency is desired.

Figure 1:
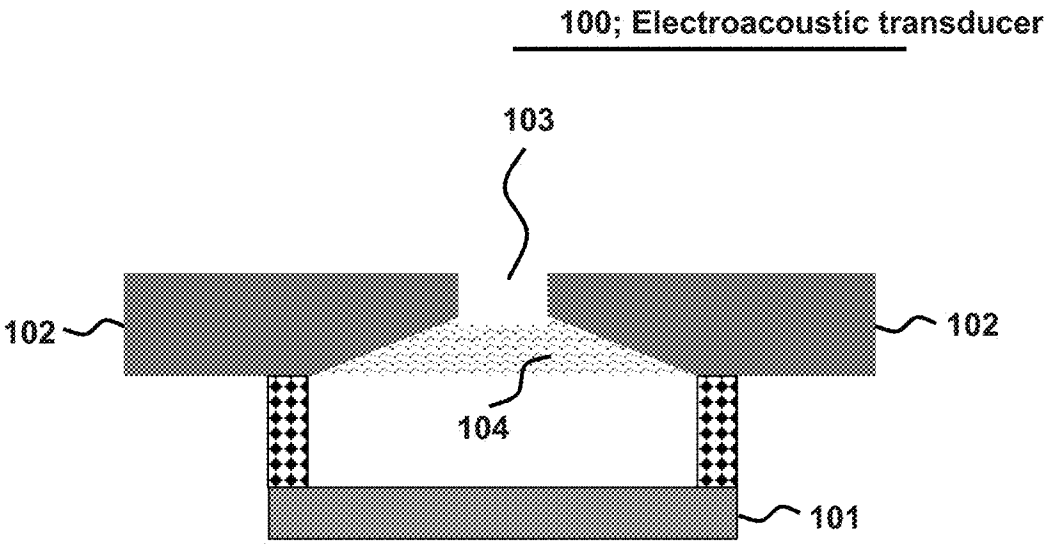
FIG. 1 is a drawing for explaining an exemplary embodiment.

An electroacoustic transducer 100 shown in FIG. 1 is provided as an example. The electroacoustic transducer 100 comprises a piezoelectric vibrator 101, and a casing 102 provided with a predetermined space from the piezoelectric vibrator 101. The piezoelectric vibrator 101 transmits a sound wave(s) vibrating by being applied an electric field. And, a sound hole 103 is formed in the casing 102 in front of the piezoelectric vibrator 101 in an oscillating direction of the piezoelectric vibrator 101. A sound wave(s) transmitted from the piezoelectric vibrator 101 is emitted from the sound hole 103 to atmosphere. Further, in the following description, a cylindrical shaped path(es) where the sound wave(s) transmitted from the piezoelectric vibrator 101 gets through before the sound wave(s) arrives at the sound hole 103 is referred to as a sound path.

Here, the casing 102 has a frustum shape cutout in an inner wall thereof. The cutout is formed in the casing 102 such a hole diameter of the sound path decreases toward a front end in the transmitting direction of the piezoelectric vibrator 101. Therefore, because of a frustum shape, the sound wave(s) transmitted from the piezoelectric vibrator 101 is controlled such that the sound wave(s) gets through the sound path and toward the sound hole 103. Concretely, in the case that the inner wall of the casing 102 is truncated shaped, divergence of the sound wave(s) transmitted from the piezoelectric vibrator is suppressed. As a result, the cutout contributes to collecting the sound wave(s) transmitted from the piezoelectric vibrator 101 and making a directivity be higher.

Further, an acoustic absorption 104 material is disposed being fitted in the cutout formed in the casing 102. The acoustic absorption 104 contributes to preventing an interference between the sound waves. Further, the acoustic absorption 104 contributes to cancelling a sound wave(s) having a frequency(es) except that of a replaying ultrasonic wave(s). Therefore, the electroacoustic transducer 100 contributes to transmitting highly directional acoustic waves with high efficiency.

In the present invention, the following modes are available.

[Mode 1] As the electroacoustic transducer relating to the first aspect.

[Mode 2] It is preferred that the casing has the cutout including a truncated polygonal shape or truncated cone shape.

[Mode 3] It is preferred that the acoustic absorption material includes a porous material(s).

[Mode 4] It is preferred that the sound hole is formed at a distance between ¼ and ½ of a wave length of an oscillating wave(s) from a vibrating surface of the piezoelectric vibrator.

[Mode 5] It is preferred that the piezoelectric vibrator transmits an ultrasonic wave(s) having more than 20 kHz frequency.

[Mode 6] It is preferred that the electroacoustic transducer comprises a plurality of the electroacoustic transducer according to any one of modes 1 to 5 arranged in parallel on a plane.

[Mode 7] As the electronic device relating to the second aspect.

[Mode 8] As the manufacturing method of an electroacoustic transducer relating to the third aspect.

[Mode 9] It is preferred that the cutout including a truncated polygonal shape or truncated cone shape is formed.

[Mode 10] It is preferred that, the sound hole is formed at a distance between ¼ and ½ of a wave length of an oscillating wave(s) from a vibrating surface of the piezoelectric vibrator.

Concrete exemplary embodiments will be described below in more detail with reference to the drawings. In the following description, various concrete matters are to facilitate understanding of the present invention for explanation.

Exemplary Embodiment 1

A first exemplary embodiment will be described in more detail with reference to the drawings.

Figure 2:
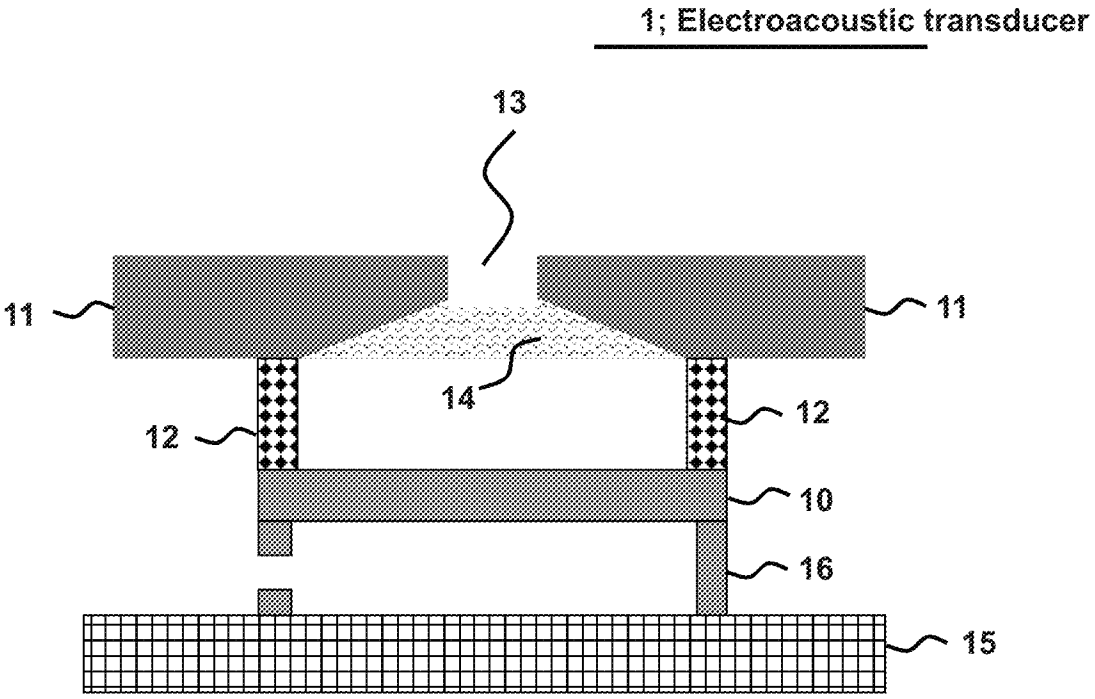
FIG. 2 is a drawing for a drawing of a sectional side view showing an example of an electroacoustic transducer 1 relating to the first exemplary embodiment.

FIG. 2 is a drawing of a sectional side view showing an example of an electroacoustic transducer 1 relating to the present exemplary embodiment. Further, for simplicity, FIG. 2 only shows members relevant to the electroacoustic transducer 1 relating to the present exemplary embodiment.

The electroacoustic transducer 1 is set inside of a casing 11. For example, the electroacoustic transducer 1 is used as a speaker device. The speaker device may be a parametric speaker. In the case of using the electroacoustic transducer 1 as a parametric speaker, it is preferred that a piezoelectric vibrator 10 transmits an ultrasonic wave(s) having more than 20 kHz frequency. In that case, the parametric speaker demodulates the ultrasonic wave(s) to audible sound as a carrier wave(s). Concretely, at first, the parametric speaker emits the ultrasonic wave(s) modulated toward atmosphere. Then, the parametric speaker demodulates a modulation wave(s) by inducing a collision wave(s) by nonlinear phenomenon of air.

Further, when the piezoelectric vibrator 10 transmits an ultrasonic wave(s) with high straightness, a sound field with a high directivity can be formed. As a result, the electroacoustic transducer 1 relating to the present exemplary embodiment can emit a sound wave(s) around vicinity of a user.

For example, it is preferred that the electroacoustic transducer 1 is a sound source of a smartphone, a mobile phone, a game device, a tablet PC (Personal Computer), a note PC, and a PDA (Personal Data Assistants).

And, the piezoelectric vibrator 10 is jointed with the casing 11 via a jointing member. Also, a substrate 15 is disposed with a predetermined space from a surface of the piezoelectric vibrator 10 opposite to the casing 11. And, the piezoelectric vibrator 10 is jointed with the substrate via a holding member 16.

The piezoelectric vibrator 10 is configured by restricting an piezoelectric substance 21 polarized in a direction toward thickness. And, the piezoelectric vibrator 10 transmits a sound wave(s) vibrating by being applied an electric field. Therefore, it is preferred that an electric device comprising the electroacoustic transducer 1 comprises an oscillating circuit (not shown in the drawing) that generates an electric signal being applied to the piezoelectric substance 21.

The casing 11 is provided with a predetermined space from the piezoelectric vibrator 10. And, a sound hole 13 is formed in the casing 10 in front of the piezoelectric vibrator in an oscillating direction of the piezoelectric vibrator 10. A sound wave(s) that the piezoelectric vibrator 10 transmits gets through a sound hole 13 and is emitted onto outside of the electroacoustic transducer 1.

Further, the casing 11 has a frustum shape cutout in an inner wall thereof. The cutout includes a truncated polygonal shape or truncated cone shape, etc. And, the cutout is formed in the casing 11 such that a hole diameter of a sound path decreases toward a front end in the oscillating direction of the piezoelectric vibrator 10. For the sake that the cutout is formed, the sound wave(s) is collected on the cutout region.

As a result, the electroacoustic transducer 1 can emit the sound wave(s) from the sound hole 13 efficiently.

And, an acoustic absorption material 14 is disposed being fitted in the cutout formed in the casing 11. It is preferred that the acoustic absorption material 14 is a porous material(s), for example, polyurethane, etc. A frequency(es) to be cancelled can be arranged by arranging a shape(s) of the porous material(s). Concretely, when sound wave(s) is entered into vacancies of the porous material(s), the sound wave(s) diffuses in the vacancies. Therefore, according to the shape of the vacancies, a wave(s) having a predetermined frequency(es) diffuses and decreases.

It is preferred that a sound hole 13 is formed at a distance between ¼ and ½ of a wave length of an oscillating wave(s) from a vibrating surface of the piezoelectric vibrator 10. As a result of making a distance between the sound hole 13 and a surface of piezoelectric vibrator 10 be restricted in this range, it is possible to cancel an unnecessary ultrasonic wave(s) efficiently.

Figure 3:
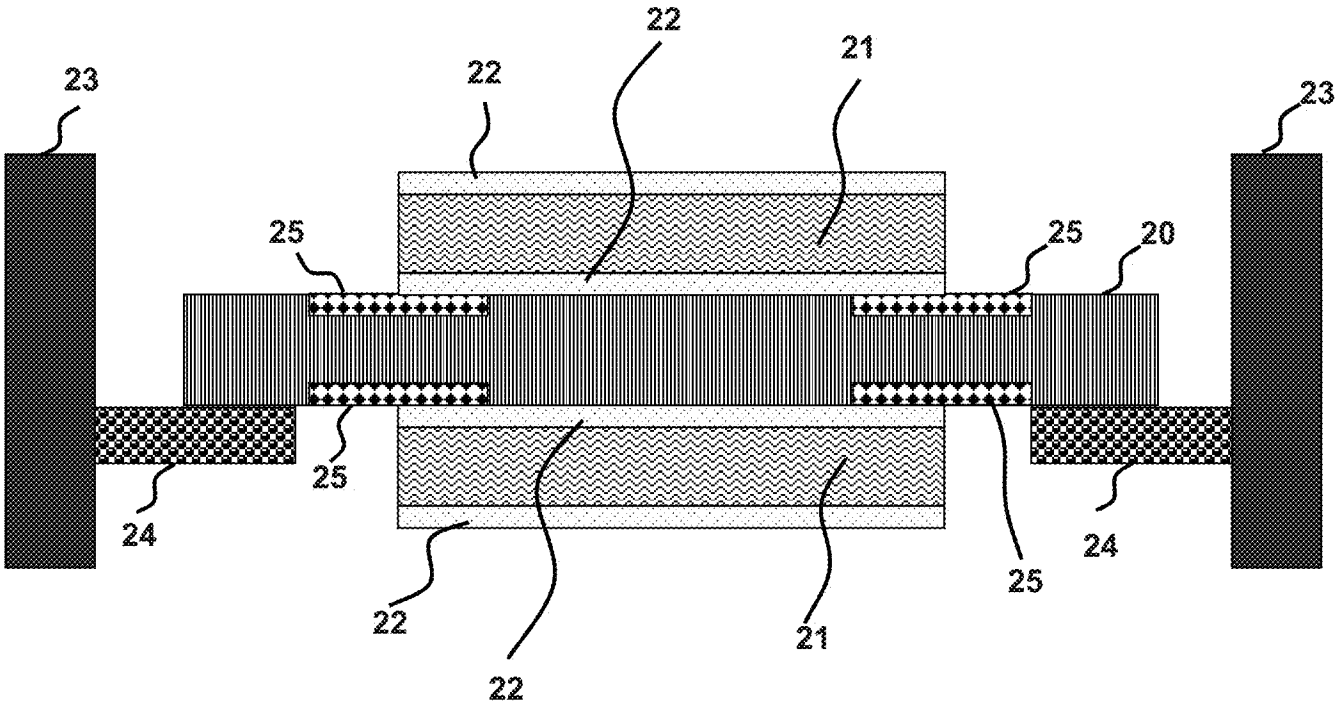
FIG. 3 is a drawing of a sectional side view showing an example of the piezoelectric vibrator 10 relating to the first exemplary embodiment.

FIG. 3 is a drawing of a sectional side view showing an example of the piezoelectric vibrator 10. For simplicity, FIG. 3 only shows members relevant to the electroacoustic transducer 1 relating to the present exemplary embodiment.

A vibrating member 20 has functions to propagate vibrations generated on the piezoelectric vibrator 10 to the whole of the electroacoustic transducer 1. And, as shown in FIG. 3, it is preferred that the piezoelectric vibrator 10 has a structure (a bimorph structure) that the piezoelectric substance 21 is restricted on both sides of main surfaces of the vibrating member 20. When the piezoelectric vibrator 10 has the bimorph structure, an amplitude value of the piezoelectric vibrator 10 increases than the case that the piezoelectric vibrator 10 has an unimorph structure. Further, the unimorph structure is a structure that the piezoelectric substance 21 is restricted on one of main surfaces of the vibrating member 20

An electrode 22 is restricted on the both sides of the piezoelectric substance 21. Therefore, the piezoelectric substance 21 is polarized in a direction toward thickness. A material(s) composing the piezoelectric substance 21 is a material(s) with piezoelectric effect, and may be an inorganic material(s) or an organic material(s). For example, they may be a piezoelectric ceramic which is, for example, a lead zirconate titanate, a barium titanate, etc.

Also, a material(s) composing the electrode 22 is not limited, and may be, for example, a silver, a silver/palladium. The silver has a low electrical resistance, and is used as a generic electrode material. The silver/palladium has a low electrical resistance, furthermore, has a high resistance for oxidation. Further, there are various materials preferred for electrodes, but details of the materials preferred for the electrodes are not limited.

Now, as described above, it is preferred that the piezoelectric substance 21 is a piezoelectric ceramic, but the piezoelectric ceramic is brittle. That is why, in the case that the piezoelectric substance 21 is composed by the piezoelectric ceramic, it is difficult to change a shape of the piezoelectric substance 21. Therefore, it is preferred to change a resonance frequency by changing a thickness, materials, etc. of vibrating member 20 which restricts the piezoelectric substance 21.

Therefore, it is preferred that the vibrating member 20 has a high rigidity against the piezoelectric substance 21. In the case that a rigidity of the vibrating member 20 is too low, or too high, there is a possibility of reducing a characteristic or a reliability as a mechanical vibrator. For example, the vibrating member 20 may be composed of a metallic material(s) which is a phosphor bronze, stainless, etc. Or, the vibrating member 20 may be a composite material of a metallic material and a resin. As a result of making the vibrating member 20 be composed of the composite material of the metallic material and the resin, it can be contribute to arrange the rigidity of the vibrating member 20. There are various materials preferred for the vibrating member 20, but details of the material preferred for the vibrating member 20 are not limited.

Also, the vibrating member 20 may be jointed with a frame 23 via a supporting member 24. A material(s) composing the frame 23 is not limited if the material(s) has a high rigidity. The material(s) composing the frame 23 may be a metallic material, an organic material, etc. For example, the material(s) composing the frame 23 may be a stainless, brass, etc.

A material(s) composing the supporting member 24 is not limited if the material(s) absorbs vibration. For example, a material composing the supporting member 24 may be a resin material. When the piezoelectric vibrator 10 vibrates, the supporting member 24 contributes to reducing a rigidity of a edge region where a stress concentrates. Then, the supporting member 24 contributes to increasing an amplitude of the piezoelectric vibrator 10.

Further, when the piezoelectric vibrator 10 vibrates, a stress concentrates on a contact region between the vibrating member 20 and the piezoelectric substance 21. Therefore, it is preferred to dispose an elastic member 25 at a stress concentrating region of the vibrating member 20. Here, a material(s) composing the elastic member 25 is not limited, if the material(s) has a high flexibility. Also, an elasticity of the vibrating member 20 may be arranged by forming a coating film on the vibrating member 20. By providing the elastic member 25 as the vibrating member 20, an impact resistance on falling is improving.

As described above, the electroacoustic transducer 1 can cancel a sound wave(s) having unnecessary frequency. Therefore, the electroacoustic transducer 1 can emit an ultrasonic wave(s) having a predetermined frequency with high efficiency.

Exemplary Embodiment 2

A second exemplary embodiment will be described in more detail with reference to the drawings.

In the second exemplary embodiment, the electroacoustic transducer 1 relating to the first exemplary embodiment are disposed in parallel on a plane. Note that the description that overlaps with the first exemplary embodiment will be omitted in the description of the present exemplary embodiment. Further, the same signs are given to the elements same as those in the first exemplary embodiment and the explanation thereof will be omitted in the description of the present exemplary embodiment.

Figure 4:
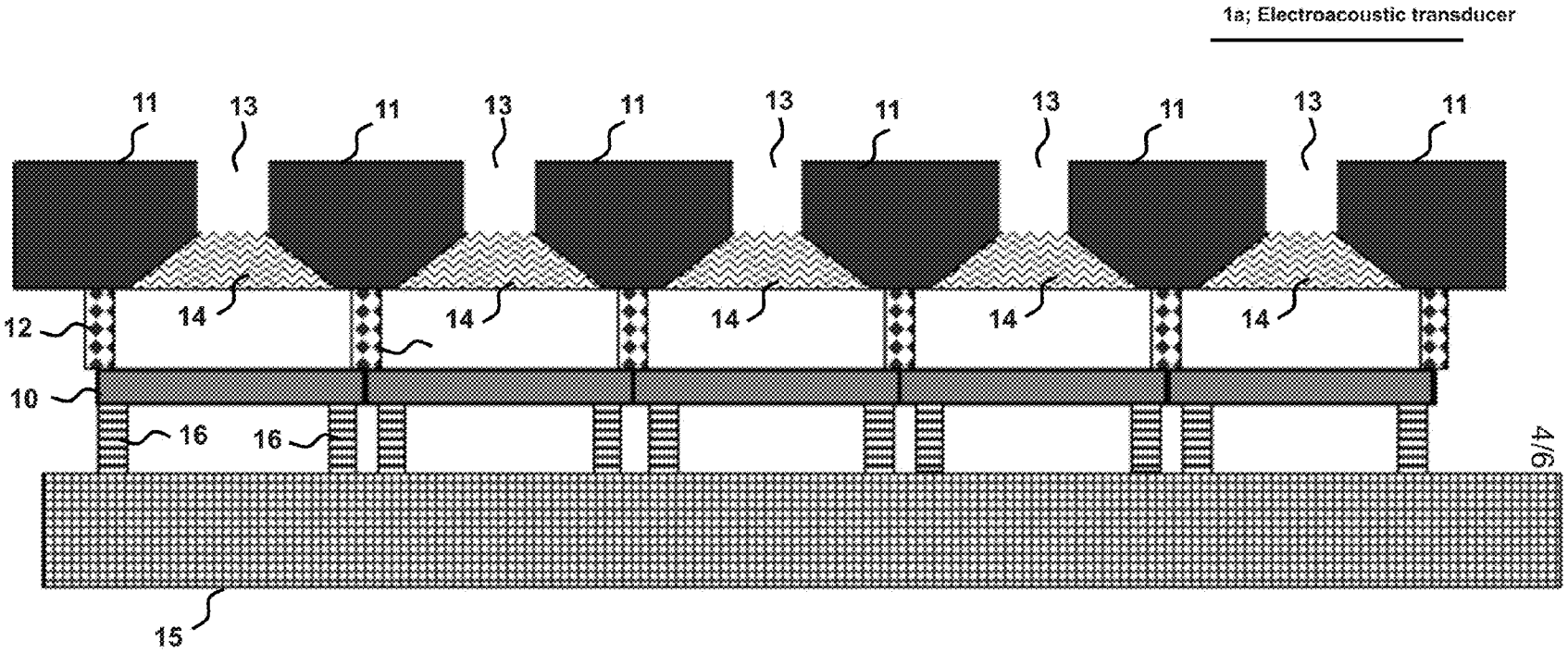
FIG. 4 is a drawing of side view of showing an example of an structure of an electroacoustic transducer 1*a* relating to the second exemplary embodiment.

FIG. 4 is a drawing of side view of showing an example of an structure of an electroacoustic transducer 1*a* relating to the present exemplary embodiment.

Each of the piezoelectric vibrator 10 is jointed with the casing 11 via the jointing member 12. Also, each of the piezoelectric vibrator 10 is jointed with the substrate 15 via a holding member 16. And, a frustum shape cutout in the casing 11 is formed on a sound path on which a sound wave(s) generated from each of the piezoelectric vibrator 10 propagates.

And, by selectively driving one or plurality of the piezoelectric vibrator 10 among the piezoelectric vibrator 10 configuring the electroacoustic transducer 1*a* of the present exemplary embodiment, it is possible to improve directivity of the electroacoustic transducer 1*a*. Namely, by selectively driving the piezoelectric vibrator 10, it is possible to form a sound field toward a specific direction.

Figure 5:
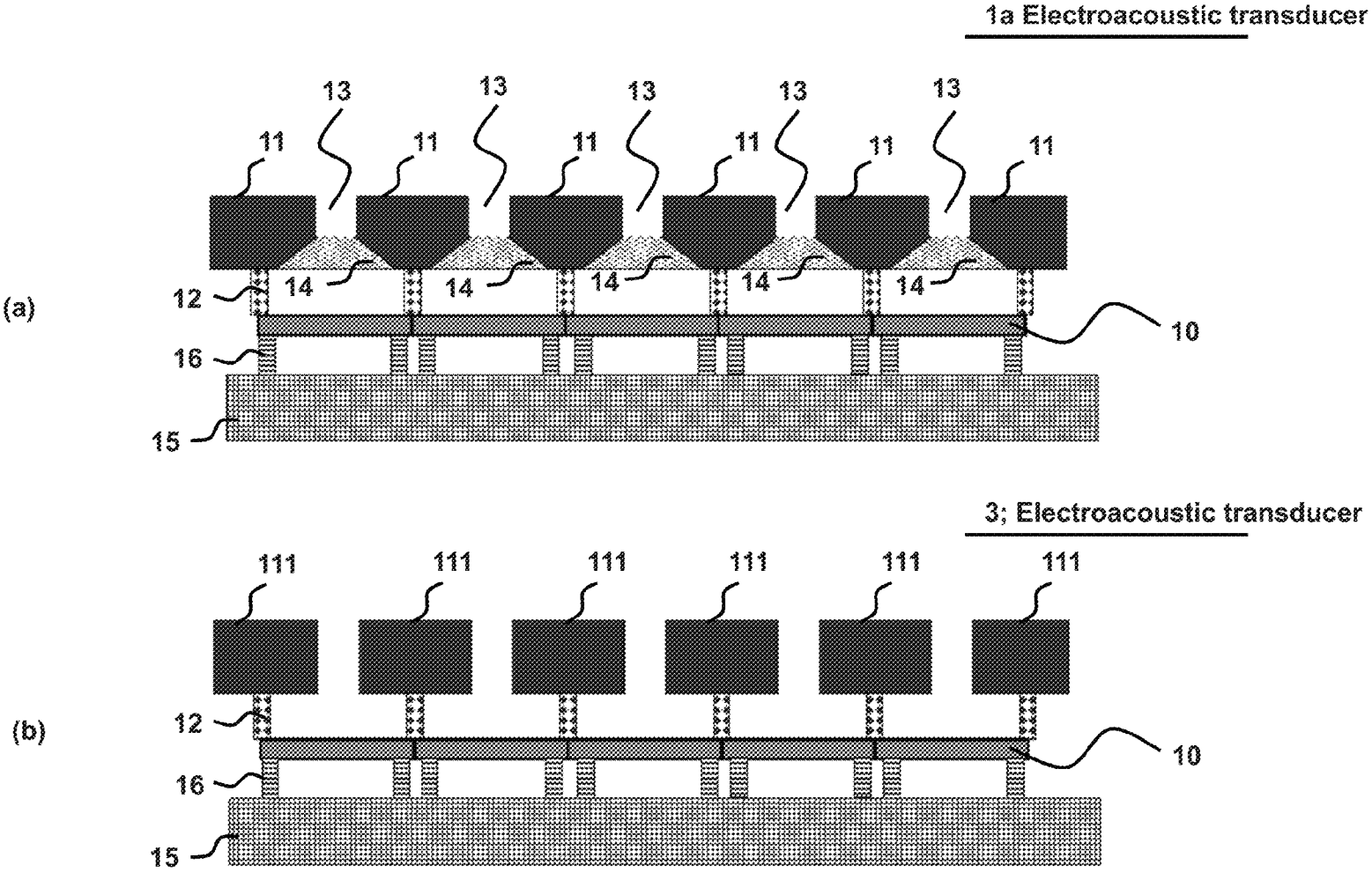
FIG. 5 is a drawing of showing an example of a structure relating to the second exemplary embodiment, and a structure relating to comparative embodiment.

FIG. 5 is a drawing of showing an example of a comparative structure comprising the piezoelectric vibrator 10 and the casing 11. FIG. 5(*a*) is a drawing of showing an example of an electroacoustic transducer 1*a* relating to the present exemplary embodiment. FIG. 5(*b*) is a drawing of showing an example of an electroacoustic transducer 3 that does not form a frustum shape cutout and does not have an acoustic absorption material 14. In the both structures shown in FIGS. 5(*a*) and 5(*b*), the electroacoustic transducers comprising the piezoelectric vibrator 10 are arranged in an array. In the following description, the structure of the electroacoustic transducer 1*a* shown in FIG. 5(*a*) is referred to as "a structure of the present exemplary embodiment". On the other hand, the structure of the electroacoustic transducer 3 shown in FIG. 5(*b*) is referred to as "a structure of a comparative embodiment".

Figure 6:
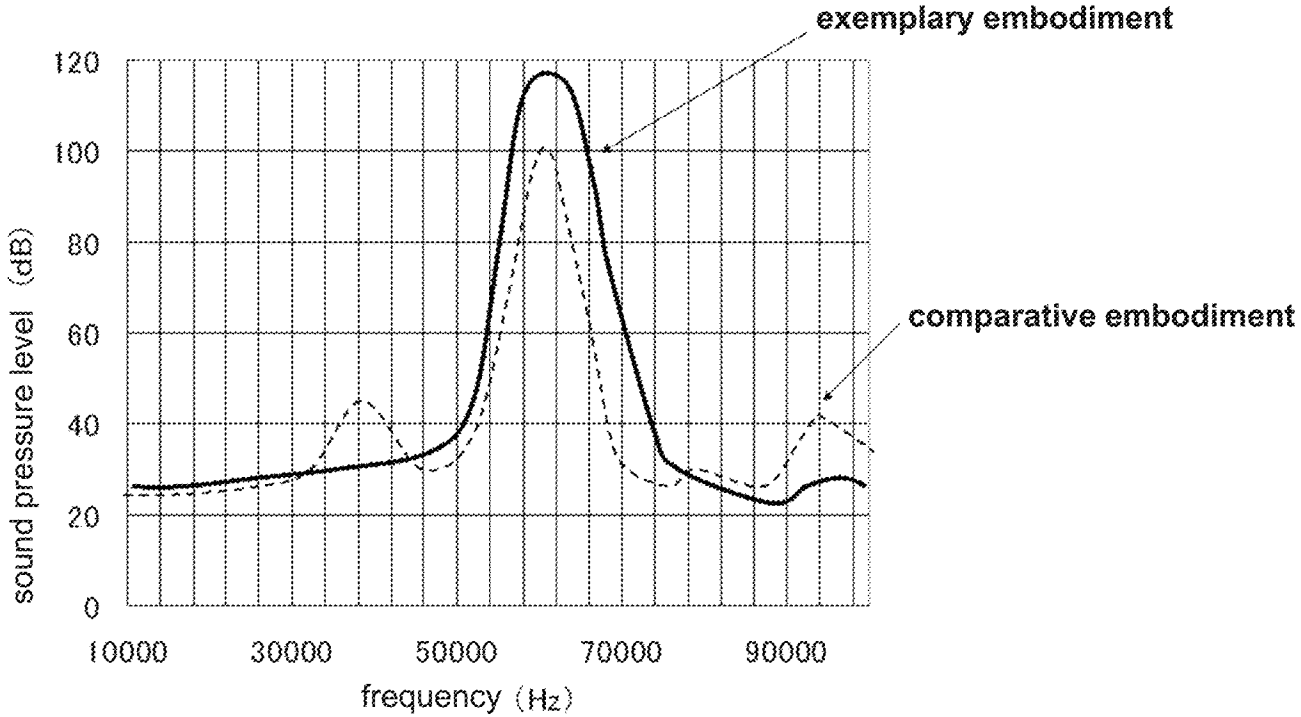
FIG. 6 is a drawing of showing an example of a measurement result of frequency and sound pressure level.

And, FIG. 6 is a drawing of showing an example of a measurement result of frequency and sound pressure level regarding the structure of the present exemplary embodiment and the structure of the comparative embodiment. Further, in FIG. 6, regarding the structure of the present exemplary embodiment and the structure of the comparative embodiment, physical properties of members in common are consistent. Furthermore, in FIG. 6, regarding the structure of the present exemplary embodiment and the structure of the comparative embodiment, let's assume that measurement conditions including temperature etc. are same.

As shown in FIG. 6, regarding the structure of the present exemplary embodiment and the structure of the comparative embodiment, the sound pressure level gets a peak value on about 60 kHz. But, a peak value of the sound pressure level of the structure of the present exemplary embodiment are higher than that of the structure of the comparative embodiment. Therefore, it can be recognized that the structure of the present exemplary embodiment improve the sound pressure level than the structure of the comparative embodiment.

Also, in the structure of the present exemplary embodiment, changes of the sound pressure make a single peak. On the other hand, in the structure of the comparative embodiment, changes of the sound pressure levels make a plurality of peak. Concretely, in the structure of the comparative embodiment, the sound pressure level gets increased on about 40 kHz, about 60 kHz, and about 95 kHz. Therefore, As shown in FIG. 6, it can be acknowledged that the structure of the present exemplary embodiment can cancel an ultrasonic wave(s) having redundant frequencies. Further, FIG. 6 is a drawing of showing an example of a comparative structure of the present exemplary embodiment and the structure of the comparative embodiment. Therefore, it is reasonable that frequency, sound level, etc. in which the sound pressure level gets a peak value change according to a figure of each member, a physical property of each member, and measurement conditions.

In the exemplary embodiment above, it is explained about a bimorph structure that the piezoelectric substance 21 is restricted on both sides of main surfaces of the vibrating member 20. However, a structure (the unimorph structure) that the piezoelectric substance 21 is restricted on one of main surfaces of the vibrating member 20 can be applied to the exemplary embodiment.

The disclosure of the above Patent Literature and Non-Patent is incorporated herein by reference thereto. Modifications and adjustments of the exemplary embodiments and examples are possible within the scope of the overall disclosure (including the claims) of the present invention and based on the basic technical concept of the present invention. Various combinations and selections of various disclosed elements (including each element in each claim, exemplary embodiment, example, drawing, etc.) are possible within the scope of the claims of the present invention. Namely, the present invention of course includes various variations and modifications that could be made by those skilled in the art according to the overall disclosure including the claims and the technical concept.

1, 1*a*, 3, 100 electroacoustic transducer
10, 101 piezoelectric vibrator
11, 102, 111 casing
12 jointing member
13, 103 sound hole
14, 104 acoustic absorption material
15 substrate
16 holding member
20 vibrating member
21 piezoelectric substance
22 electrode
23 frame
24 supporting member
25 elastic member

What is claimed is:

1. An electroacoustic transducer, comprising:
a piezoelectric vibrator;
a casing being provided with a predetermined space from the piezoelectric vibrator and including a frustum shape cutout in an inner wall thereof; and
an acoustic absorption material being fitted in the cutout;
wherein a sound hole is formed in the casing in front of the piezoelectric vibrator in an oscillating direction of the piezoelectric vibrator; and
the casing is formed in the casing such that a hole diameter of a sound path decreases toward a front end in the oscillating direction of the piezoelectric vibrator.

2. The electroacoustic transducer according to claim 1, wherein the casing has the cutout including a truncated polygonal shape or truncated cone shape.

3. The electroacoustic transducer according to claim 1, wherein the acoustic absorption material includes a porous material(s).

4. The electroacoustic transducer according to claim 1, wherein the sound hole is formed at a distance between ¼ and ½ of a wave length of an oscillating wave(s) from a vibrating surface of the piezoelectric vibrator.

5. The electroacoustic transducer according to claim 1, wherein the piezoelectric vibrator transmits an ultrasonic wave(s) having more than 20 kHz frequency.

6. An electroacoustic transducer comprising a plurality of the electroacoustic transducer according to claim 1 arranged in parallel on a plane.

7. An electronic device, comprising the electroacoustic transducer according to claim 1, wherein the electronic device being configured to oscillate the piezoelectric vibrator such that an ultrasonic wave(s) having more than 20 kHz frequency is emitted.

8. A manufacturing method of an electroacoustic transducer comprising a piezoelectric vibrator and a casing, the manufacturing method comprising:
providing with a predetermined space from a piezoelectric vibrator;
forming a frustum shape cutout in an inner wall of the casing;
disposing a acoustic absorption fitted in the cutout; and
forming a sound hole in the casing in front of the piezoelectric vibrator in an oscillating direction of the piezoelectric vibrator;

wherein, the cutout is formed in the casing such that a hole diameter of a sound path decreases toward a front end in the oscillating direction of the piezoelectric vibrator.

9. The manufacturing method of the electroacoustic transducer according to claim 8, wherein the cutout including a truncated polygonal shape or cone truncated cone shape is formed.

10. The manufacturing method of the electroacoustic transducer according to claim 8, wherein the sound hole is formed at a distance between ¼ and ½ of a wave length of an oscillating wave(s) from a vibrating surface of the piezoelectric vibrator.

* * * * *